US007162882B2

(12) United States Patent
Alahyari et al.

(10) Patent No.: US 7,162,882 B2
(45) Date of Patent: Jan. 16, 2007

(54) MULTI-BAND AIR CURTAIN SEPARATION BARRIER

(75) Inventors: Abbas A. Alahyari, Manchester, CT (US); Mary D. Saroka, Syracuse, NY (US)

(73) Assignee: Carrier Corporation, Farmington, CT (US)

( * ) Notice: Subject to any disclaimer, the term of this patent is extended or adjusted under 35 U.S.C. 154(b) by 119 days.

(21) Appl. No.: 11/018,281

(22) Filed: Dec. 21, 2004

(65) Prior Publication Data

US 2005/0138943 A1 Jun. 30, 2005

Related U.S. Application Data

(63) Continuation-in-part of application No. PCT/US04/00137, filed on Jan. 6, 2004, which is a continuation-in-part of application No. 10/752,134, filed on Jan. 6, 2004, now abandoned, and a continuation-in-part of application No. 10/374,640, filed on Feb. 26, 2003, now abandoned, and a continuation-in-part of application No. 10/337,591, filed on Jan. 7, 2003, now Pat. No. 6,722,149.

(51) Int. Cl.
*A47F 3/04* (2006.01)

(52) U.S. Cl. ..... 62/89; 62/256

(58) Field of Classification Search ..... 62/256; 454/193

See application file for complete search history.

(56) References Cited

U.S. PATENT DOCUMENTS 3,182,466 A 5/1965 Beckwith
3,230,733 A 1/1966 Rutishauser et al.
3,233,423 A 2/1966 Beckwith et al.
3,289,432 A 12/1966 Brennan et al.
3,304,736 A 2/1967 Brennan et al.
3,648,482 A 3/1972 Beckwith et al.
3,712,078 A 1/1973 Maynard et al.
3,827,254 A 8/1974 MacMaster et al.
3,847,135 A 11/1974 Sherman
3,850,003 A 11/1974 Beckwith et al.
3,888,091 A 6/1975 Butts
3,937,033 A 2/1976 Beckwith et al.
4,117,698 A 10/1978 Vogel
4,269,037 A 5/1981 Karashima
4,326,385 A 4/1982 Ibrahim
4,414,822 A * 11/1983 Ibrahim ..... 62/256
4,457,140 A 7/1984 Rastelli (Continued)

*Primary Examiner*—William E. Tapolcai
(74) *Attorney, Agent, or Firm*—Wall Marjama & Bilinski LLP

(57) ABSTRACT

A multi-band air curtain forms a separation barrier at an interface between a first environment having a fluid at a first condition and a second environment having a fluid at a second condition. A first stream (55) of a fluid is directed along a first path (45) generally parallel to the interface between the first environment and the second environment. A second stream (65) of fluid is directed along a second path (75) generally outwardly at an angle of divergence with the first path (45). A third stream (65) of a fluid is directed along a third path (95) between the first path (45) and the second path (75) at a first interior angle with said first path (45) and at a second interior angle with said second path (75). A refrigerated merchandiser (10) is also disclosed having a display case having an interior defining a product display region (30) having an open front and first (34), second (70) and third (58) air outlets for directing first (55), second (65) and third air (85) streams, respectively, across the open front of the refrigerated merchandiser in a divergent manner.

17 Claims, 1 Drawing Sheet

U.S. PATENT DOCUMENTS

| | | | | |
|---|---|---|---|---|
| 4,608,776 | A | 9/1986 | Kooy | |
| 4,680,942 | A | 7/1987 | Kooy | |
| 4,845,957 | A | 7/1989 | Richardson | |
| 4,938,034 | A | 7/1990 | Rosanio et al. | |
| 5,048,303 | A | 9/1991 | Campbell et al. | |
| 5,086,627 | A | 2/1992 | Borgen | |
| 5,345,778 | A | 9/1994 | Roberts | |
| 5,347,827 | A | 9/1994 | Rudick et al. | |
| 5,357,767 | A | 10/1994 | Roberts | |
| 5,402,654 | A | 4/1995 | Rudick et al. | |
| 5,417,079 | A | 5/1995 | Rudick et al. | |
| 5,417,081 | A | 5/1995 | Rudick et al. | |
| 5,502,979 | A | 4/1996 | Renard | |
| 5,678,421 | A | 10/1997 | Maynard et al. | |
| 5,953,929 | A | 9/1999 | Bauman et al. | |
| 5,966,958 | A | 10/1999 | Maynard | |
| 6,070,424 | A | 6/2000 | Bauman et al. | |
| 6,234,894 | B1 | 5/2001 | Goracke et al. | |
| 6,367,274 | B1 * | 4/2002 | Mellado | 62/256 |
| 6,701,736 | B1 | 3/2004 | Johnson | |
| 6,701,739 | B1 | 3/2004 | Morse | |
| 6,722,149 | B1 * | 4/2004 | Saroka et al. | 62/256 |
| 6,948,324 | B1 | 9/2005 | Jin | |
| 2004/0134221 | A1 | 7/2004 | Fee et al. | |

* cited by examiner

MULTI-BAND AIR CURTAIN SEPARATION BARRIER

CROSS-REFERENCE TO RELATED APPLICATIONS

This application is a continuation-in-part application of Patent Cooperation Treaty Application Ser. No. PCT/US04/00137, having an international filing date of Jan. 6, 2004, and published in English on Jul. 29, 2004, as PCT Publication No. 04/062762, which is a continuation-in-part of U.S. patent application Ser. No. 10/337,591, filed Jan. 7, 2003, now U.S. Pat. No. 6,722,149, issued Apr. 20, 2004, and a continuation-in-part of U.S. patent application Ser. No. 10/752,134, filed Jan. 6, 2004, which is a continuation-in-part of U.S. patent application Ser. No. 10/374,640, filed Feb. 26, 2003, now abandoned.

BACKGROUND OF THE INVENTION

The present invention relates generally to air curtains for separating a first environment from a second environment. The method of the present invention may be advantageously applied to refrigerated display merchandisers of the type used in supermarkets, mini-marts, convenience stores and other commercial establishments for displaying and merchandising refrigerated or frozen products for sale, wherein an air curtain separates the open-front, product display area from the ambient store environment.

Refrigerated display merchandisers, also commonly referred to as display cases, having open front display regions are commonly used in supermarkets, mini-marts, convenience stores and other commercial establishments for displaying and merchandising refrigerated or frozen products for sale. The open front nature of such display cases permits the consumer to simply reach into the product display region to select and remove a product for purchase without the inconvenience of needing to open a door to access the product. Customarily, a curtain of cold refrigerated air is passed downwardly at a relatively high velocity across the open front of the display case to form an invisible boundary between the product display region and the region of the store in front of the display case. This air curtain not only helps retain cool refrigerated air within the product display region of the display case, thereby cooling the display product on the shelves of the display case, but also functions to isolate, to a certain extent, the product display region from the ambient air within the store. Ambient air that does enter into open product display region undesirably causes increased energy consumption by increasing the cooling demand on the refrigeration system associated with the display case. Further, such ambient air may also cause a local temperature rise within the product display region sufficient to result in an undesirable rise in product temperature that could adversely impact upon product quality.

A problem encountered with when passing a curtain of refrigerated air downwardly across the open front of the product display region of the display case lies in the entrainment of ambient air into the stream of refrigerated air forming the air curtain. Turbulence exists at the boundary between the relatively high velocity curtain air and the generally quiescent ambient air lying in front of the display case. As a result of such turbulence, some ambient air is undesirably entrained into the air curtain. Multiple air curtain display cases have been developed in the prior art to address this entrainment problem. For example, display cases having two adjacent, parallel, but independently generated, air curtains of refrigerated air are common in the art. Typically, such as disclosed by Maehara in U.S. Pat. No. 4,633,677, the outermost air curtain has a slightly higher temperature than the innermost air curtain, so as to protect the colder innermost air curtain from the impact of ambient air entrainment. However, such designs do not completely eliminate the intrusion of ambient air into the refrigerated air curtain.

Also, it is well known in the art to establish a third air curtain of relatively high velocity ambient air outwardly of one or two refrigerated air curtains as a means of reducing entrainment of ambient air from the store into the refrigerated air curtains. Abraham, in U.S. Pat. No. 4,267,706, discloses establishing an ambient air curtain outwardly of an innermost refrigerated air curtain, with the outer ambient air curtain being directed downwardly parallel to and adjacent to the inner refrigerated air curtain.

Beckwith et al, in U.S. Pat. Nos. 3,648,482 and 3,850,003, MacMaster et al, in U.S. Pat. No. 3,827,254 and Roberts, in U.S. Pat. Nos. 5,345,778 and 5,357,767, each disclose establishing an ambient air curtain outwardly of a pair of refrigerated air curtains. The curtain closest to the product display region of the display case is coolest, while the center curtain is at a temperature slightly warmer than the innermost curtain, but substantially cooler than the outermost ambient air curtain. The center curtain of warmer refrigerated air serves to buffer the innermost colder refrigerated air curtain from warm air intrusion from the outermost ambient air curtain. The outermost curtain of ambient air is directed substantially vertically downwardly, either parallel to and adjacent the center air curtain or slightly inwardly toward the center air curtain, so as to preclude refrigerated air from the center and innermost refrigerated air curtains from spilling out of the product display region of the display case. The outermost ambient air curtain itself ideally spills into the store near the base of the display case so as to not be drawn into the air return inlets through which the refrigerated air curtains return to the evaporator compartment. Although generally quite effective in reducing intrusion of ambient air into the colder innermost refrigerated air curtain, some intrusion into the center refrigerated air stream will occur.

SUMMARY OF THE INVENTION

It is an object of the present invention to provide a method for establishing a separation barrier at an interface between a first environment and a second environment. It is a further object of the present invention to provide a refrigerated merchandiser utilizing a multi-layer air curtain system across the open front of the display case.

In one aspect of the present invention, a method is provided for establishing a separation barrier at an interface between a first environment having a fluid at a first condition and a second environment having a fluid at a second condition. The method includes the steps of: directing a first stream of a fluid drawn from the first environment along a first path generally parallel to the interface between the first environment and the second environment, directing a second stream of a fluid drawn from the second environment between the first stream of fluid and the second environment along a second path at an angle of divergence with the first path in a direction towards the second environment ranging from about 10 degrees to about 70 degrees, and directing a third stream of a fluid along a third path between the first path and the second path at an interior angle with the first path ranging from about 5 degrees to about 35 degrees and at a second interior angle with the second path ranging from about 5 degrees to about 35 degrees, and most advantageously from 15 degrees to 35 degrees. The first fluid stream establishes a primary fluid curtain across the interface, the second fluid stream establishes a tertiary fluid curtain across the interface outwardly of the primary fluid curtain, and the third fluid stream establishes a secondary fluid curtain across the interface intermediate the primary fluid curtain and the tertiary fluid curtain.

In another aspect of the present invention, a refrigerated merchandiser is provided having a display case defining a refrigerated product display region having an open front interfacing with an ambient environment. A first discharge outlet associated with the display case directs a first stream of air at a relatively cooler temperature across the open front of the merchandiser along a first path. A second discharge outlet associated with the display case directs a second stream of air at a relatively warmer temperature generally outwardly across the open of the merchandiser along a second path at a divergent angle with respect to the first path ranging from about 10 degrees to about 70 degrees. A third air outlet associated with the display case directs a third air stream generally outwardly across the open front of the merchandiser along a third path diverging from said first path at an interior angle ranging from about 5 degrees to about 35 degrees and diverging from said second path at an interior angle ranging from about 5 degrees to about 35 degrees. The third discharge outlet is positioned between the first discharge outlet and the second discharge outlet. Advantageously, first, second and third discharge outlets may be disposed in side-by-side relationship at the upper front of the display case. The first stream of relatively cooler temperature air may constitute refrigerated air drawn from the display case and the second stream of relatively warmer temperature air may constitute ambient air drawn from the environment exterior of the refrigerated merchandiser.

In a further aspect of the present invention, the first fluid stream is directed along the first path at a first discharge velocity, the second fluid stream is directed along the second path at a second discharge velocity greater than the first discharge velocity, and the third fluid stream is directed along the third path at a third discharge velocity greater than the first discharge velocity, but not greater than, and advantageously less than, the second discharge velocity. Advantageously, the second discharge velocity may be maintained at a magnitude of at least about 1.2 times the first discharge velocity, and most advantageously within the range from about 1.2 to about 2.4 times the first discharge velocity. Further, the third discharge velocity may be maintained at a magnitude of at least about 1.2 to about 2.4 times the second discharge velocity.

BRIEF DESCRIPTION OF THE DRAWINGS

The various features and advantages of this invention will become apparent to those skilled in the art from the following detailed description of the currently preferred embodiment with reference to the accompany drawings wherein.

DETAILED DESCRIPTION OF THE PREFERRED EMBODIMENT

The present invention will be described hereinafter in application on a refrigerated merchandiser for the purpose of establishing a multi-stream air curtain barrier between the refrigerated product display area interior to the refrigerated merchandiser and the ambient area in front of the refrigerated merchandiser. It is to be understood, however, that the present invention has a much broader application. Broadly, in one aspect of the present invention, a method is provided for establishing a separation barrier at an interface between a first environment having a fluid at a first condition and a second environment having a fluid at a second condition. For example, for purposes of illustration, but not limitation, the method of the present invention could be applied to maintaining a barrier between at a warehouse door between a environmentally controlled interior and an exterior loading dock, or at a store entrance between the temperature controlled store interior and the ambient outdoor environment. Accordingly, the following description of the present invention as applied to a refrigerated merchandiser is not intend to limit the scope of the method of the present invention, but merely to illustrate the method of the present invention in a particularly advantageously application thereof.

Figure 1:
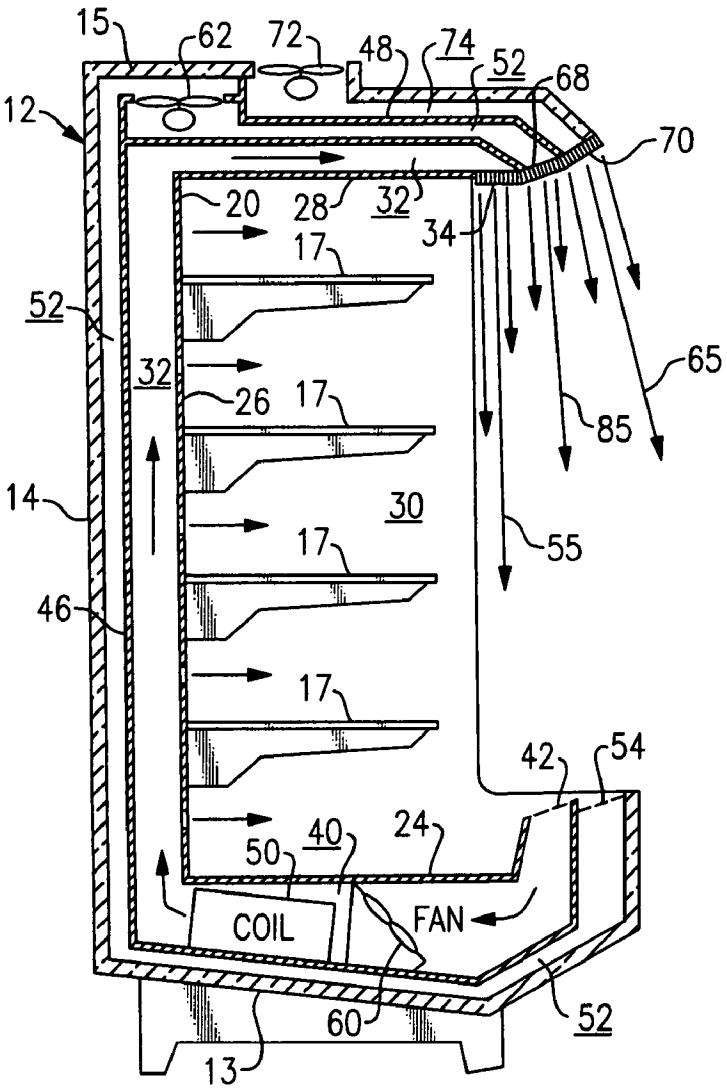
FIG. 1 illustrates a side elevation profile of a refrigerated merchandiser having van open-front display case showing an air curtain formed of three independent, divergent air streams across the open-front display case.

Referring now to FIG. 1, the refrigerated merchandiser 10 includes an outer cabinet 12 and an inner cabinet liner 20 that defines within its bounds an open-front product display region 30. The outer cabinet has a base 13, a rear wall 14 extending upwardly from the back of the base 13, a top wall 15 extending forwardly from the rear wall and a pair of side walls 16 extending vertically from the base 13 to the top wall 15 and forwardly from the rear wall 13. The inner cabinet liner 20 has a top panel 28, a back panel 26, a bottom panel 24 and opposed side panels 22 which together bound the open-front product display region 30. Each of the cabinet base 13, rear wall 14, top wall 15 and side walls 16 is insulated, as in conventional practice, to thermally isolate the interior of the cabinet 12, including the product display region 30, from excessive heat transfer therethrough.

Perishable product 80 being merchandized may be displayed on shelves 17 disposed within the product display region 30 and upon the upper surface of the bottom panel 24. The product display region 30 has an open front 25 so as to permit consumers to not only view, but also reach into the product display region 30 to select and remove items of product 80 that they desire to purchase. Product display region 30 is cooled in a conventional manner to a desired product temperature, typically to a temperature between −10° F. to less than about 40° F., depending upon what product is being merchandised therein and whether the product is frozen or non-frozen.

The refrigerated merchandiser 10 further includes a refrigeration compartment 40, typically disposed in the portion of the display cabinet beneath the bottom panel 24, as depicted in FIG. 1, wherein components of the refrigerant system, typically a tube coil evaporator 50 and a air mover 60, such as for example one or more fans, are housed. However, it is to be understood that the specific type of air mover employed is not relevant. As in conventional practice, refrigerant passing through the tubes of the evaporator 40 refrigerates, i.e. cools, air passing over the surface of the evaporator tubes. The refrigerant is typically supplied from a remote refrigeration unit located elsewhere within the store. However, it is to be understood that the present invention may also be employed on stand alone refrigerated merchandisers that include their own refrigeration unit for providing the cold refrigerant.

A first air circulation duct 32 and a second air circulation duct 52 are formed between the rear wall 14 and the top wall 15 of the outer cabinet 12 and the back panel 26 and top panel 28, respectively, of the inner cabinet liner 20. A separation wall 46 spaced intermediate the rear wall 14 and back panel 26 and the top wall 15 and the top panel 28 separates the first air circulation duct 32 and the second air circulation duct 52. The second air circulation duct 52 further extends along the base 13 of the refrigerated merchandiser beneath the refrigeration compartment 40. A third air duct 74 is disposed between the top wall 15 of the outer cabinet 12 and the top panel 28 of the inner cabinet inner 20 outwardly of the first air circulation duct 32 and the second air circulation duct 52. A separation wall 48 spaced the top wall 15 and the separation wall 46 separates the third air duct 74 from the second air circulation duct 52.

The first air circulation duct 32 extends in fluid communication between a first discharge outlet 34 and refrigeration compartment 40, opening thereto at a point downstream of the evaporator 50, and a first air inlet 42, disposed at the lower front lip of the refrigerator merchandiser and opening to the refrigeration compartment 40 upstream of the air mover 60. Air mover 60 serves to draw air from the display region 30 through the first air inlet 42, thence through the compartment 40 so as to traverse evaporator 50, and thence through duct 32 to a first air discharge outlet 34. As noted before, this circulating air has been refrigerated, i.e. cooled, to a desired temperature as it traverses the evaporator 50.

The third air duct 74 extends between a second discharge outlet 70 and an opening through the top wall 15 to the environment exterior of the refrigerated merchandiser 10, i.e. the store enviroment. An air mover 72, such as for example one or more fans, serves to draw ambient air from the environment exterior of the refrigerator 10 through the third air duct 74 to the second air discharge outlet 70. The second air circulation duct 52 extends in fluid communication between a third discharge outlet 58 and a second air inlet 54 disposed at the lower front lip of the refrigerator merchandiser outwardly of the first air inlet 42. Air mover 62, such as for example one or more fans, draws air through the second air inlet 54 into and through the second air circulation duct 52 to the third discharge outlet 58. The air drawn through the second air inlet 54, which lies outboard of the first air inlet 42 and adjacent the store environment will constitute a mix of cool refrigerated air and the warmer ambient air from the store environment.

Figure 2:
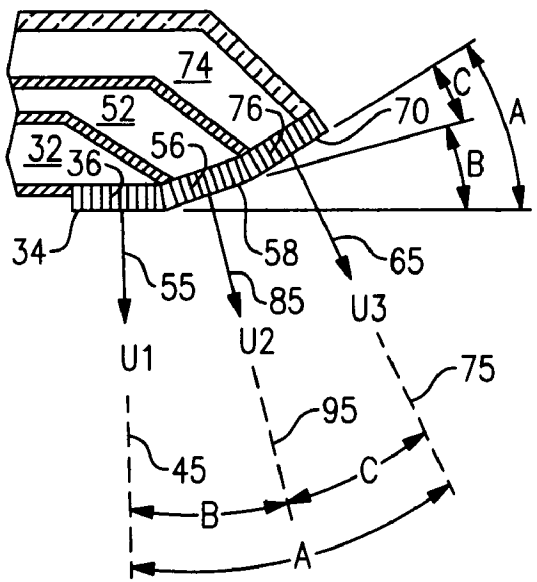
FIG. 2 illustrates a close-up view of the three outlets of the open front display through which air is directed in three independent, divergent air streams across the open-front display case.

Referring now also to FIG. 2, the first discharge outlet 34, the third discharge outlet 58 and the second discharge outlet 70 are disposed in side-by-side relationship at the forward lip of the top front of the cabinet 12. The first discharge outlet 34 lies closest to the open front of the display region 30 and constitutes the innermost discharge outlet. The second discharge outlet 70 lies further from the open front of the display region 30 and constitutes the outermost discharge outlet. The third discharge outlet 58 lies between the first discharge outlet 34 and the second discharge outlet 70 and constitutes an intermediate discharge outlet.

From the first discharge outlet 34, the cool refrigeration air discharging from the first air circulation duct 32 is directed via guide member 36 provided within the first discharge outlet 34 downwardly along first path 45 across the open front of the product display region 30 to air inlet 42, thereby forming a primary air curtain 55 of cool refrigeration air across the open-front product display region 30. To provide further cooling air directly to the product display region 30, a plurality of openings 23 may be provided in the back panel 26 through which a portion of cool refrigeration air circulating through duct 32 may pass directly into the product display region 30. This refrigeration air will also be drawn by the air mover 60 back through the air inlet 42 into the compartment 40 to be recirculated. Thus, the refrigerating air is recycled and repeatedly recirculated through the compartment 40 and duct 32 to converse energy expended in cooling the refrigeration air.

From the second discharge outlet 70, ambient air drawn from the environment exterior of the refrigerated merchandiser 10 and discharging from the duct 74 is directed by guide member 76 provided within the second discharge outlet 70 downwardly along a second path 75 across the open front of the product display region, thereby forming a tertiary air curtain 65. The tertiary air curtain 65 lies outwardly of the secondary air curtain 85.

From the third discharge outlet 58, the air discharging from the second air circulation duct 52 is directed via guide member 56 provided within the third discharge outlet 58 downwardly along third path 95 across the open front of the product display region 30 to the second air inlet 54, thereby forming a secondary air curtain 85 of cool refrigeration air across the open-front product display region 30. The secondary air curtain 85 lies outwardly of the primary air curtain 55 and inwardly of the tertiary air curtain 65. The guide members 36, 56 and 76 may each comprise a plurality of vanes defining passages therebetween, a honeycomb matrix defining a plurality of passageways, or other structure defining a plurality of parallel passageways through which the air flow discharging through the outlet is directed along a desired path.

The primary air curtain 55, which constitutes a stream of cool refrigeration air, has a relatively cool temperature compared to the tertiary air curtain 65, which constitutes a stream of ambient air and therefore has a relatively warm temperature. The secondary air curtain 85 has a temperature lying between the temperature of the primary air curtain 55 and the tertiary air curtain 65. The specific temperature of the secondary air curtain 85 will dependent upon the amount of entrainment of ambient air from the tertiary air curtain 65 into the secondary air curtain 85. The secondary air curtain 85 serves as a barrier to significantly reduce entrainment of ambient air from the tertiary air curtain 65 and the environment exterior of the open front display case into the primary air curtain 55.

The tertiary, i.e. outer, air curtain 65 of relatively warmer air drawn from the environment exterior of the refrigerated merchandiser 10 is directed downwardly and outwardly along the second path 75 at an angle of divergence, angle A, away from the first path 45 associated with the primary, i.e. inner, air curtain 55. The secondary, i.e. intermediate, air curtain 85 is directed downwardly along the third path 95 at a first interior angle, angle B, with the first path 45 associated with the primary, i.e. inner, air curtain 55, and at a second interior angle, angle C, with the second path 75 associated with the tertiary, i.e. outer, air curtain 65. The divergent angle A has a magnitude ranging from about 10 degrees to about 70 degrees. The first interior angle, angle B, has a magnitude ranging from about 5 degrees to about 35 degrees. The second interior angle, angle C, has a magnitude ranging from about 5 degrees to about 35 degrees, and most advantageously ranging from about 15 degrees to about 35 degrees.

In this manner, a relatively warm outer air curtain 65 is formed outside, i.e. further away from the product display region 30, of the relatively cool refrigerated inner air curtain 55 with an intermediate air curtain 85 that has a temperature intermediate that of the relatively cool refrigerated inner air curtain 55 and the relatively warmer outer air curtain 65. The relatively warm outer air curtain 65 serves as a buffer between the intermediate air curtain 85 and the ambient environment of the store, while the intermediate air curtain 85 serves as a buffer between the inner air curtain 55 and the relatively warm ambient temperature outer air curtain 65. Further, as the primary air curtain 55, the secondary air curtain 85 and the tertiary air curtain 65 diverge one from another as the respective air curtains pass generally downwardly, the amount of entrainment of warm air from the tertiary, i.e. outer air curtain 65, and the store environment into the cool refrigerated primary, i.e. inner, air curtain 55 is significantly reduced. Further, when the tertiary air curtain 65 reaches the base region of the display cabinet 12, it passes outwardly into the store rather than into either of the inlets 42 or 54 in the forward end of the base portion of the cabinet 12. Consequently, the entrainment of warm air into the relatively cool inner air curtain and subsequent passage through inlet 42 into the compartment 40 is minimized, thereby reducing energy consumption in cooling the recirculating refrigeration air.

In the embodiment of the refrigerated merchandiser depicted in FIGS. 1 and 2, the third discharge outlet 58, lying intermediate the first discharge outlet 34 and the second discharge outlet 70, is disposed at an angle B with the first air outlet 34 in the range from about 5 degrees to about 35 degrees and provided with axial guide member 36 such that the secondary air curtain 85 is directed to diverge away from the primary air curtain 55. Also, the second discharge outlet 70, lying outwardly of the third discharge outlet 58, is disposed at an angle A with the first air outlet 34 in the range from about 10 degrees to about 70 degrees and at an angle C with the third air outlet 58 in the range from about 5 degrees to about 35 degrees. The second discharge outlet 70 is provided with axial guide member 76 such that the tertiary air curtain 65 is directed to diverge away from the secondary curtain 85. The first discharge outlet 34, which lies inwardly of the third discharge outlet 58, is disposed generally perpendicularly to the open front of the display region 30 and is provided with axial guide member 36 such that the primary air curtain is directed generally along the open front of the display region 30.

Alternatively, the first discharge outlet 34, the second discharge outlet 70 and the third discharge outlet 58 may be disposed in the front lip at the top front of the cabinet 12 so as to lie in the same plane. In this arrangement, the guide member 76 of the second air outlet 70 and the guide member 56 of the third discharge outlet 58 are not axially arrayed within their respective discharge outlets, but rather would be positioned angularly so as to direct the respective air streams passing therethrough outwardly away from the open front of the display region at the desired angle. Thus, the guide member 76 of the second discharge outlet would be positioned so as to direct the tertiary air curtain 65 along the second path 75 so as to diverge from the inner air curtain 55 flowing along the first path 45 by an angle ranging from about 10 degrees to about 70 degrees. Similarly, the guide member 56 would be positioned within the third discharge outlet 58 so as to direct the secondary air curtain 85 along the third path 95 at a first interior angle with respect to the first path 45 ranging from about 5 degrees to about 35 degrees and at a second interior with respect to the second path 75 ranging from about 5 degrees to about 35 degrees. Further, the guide members 56 and 76, may be made adjustable such that the angle at which the secondary and tertiary air curtains diverges from the first air curtain and with respect to each other may be selectively adjusted within a range of preselected angles.

The entrainment of fluid from the second environment into the first environment across the interface therebetween, for example the entrainment of ambient air from the store into the display region through the open front thereof, may be further reduced by controlling the relative discharge velocities of the respective air curtains. The term discharge velocity refers to the velocity of the air stream discharging from its respective air outlet. For the refrigerated merchandiser depicted in FIGS. 1 and 2, the discharge velocity of the primary air curtain 55 is the velocity of the air stream discharging from first discharge outlet 34, the discharge velocity of the secondary air curtain 85 is the velocity of the air stream discharging from the third discharge outlet, and the discharge velocity of the tertiary air curtain 65 is the velocity of the air stream discharging from the second discharge outlet 70. The discharge velocity of the secondary air curtain should be maintained greater than the discharge velocity of the primary air stream, and the discharge velocity of the tertiary air stream should be maintained greater than the discharge velocity of the secondary air stream. Advantageously, the discharge velocity of the secondary air curtain should be maintained in a range from 1.2 to 2.4 times the discharge velocity of the primary air curtain and the discharge velocity of the tertiary air curtain should be maintained in a range from 1.2 to 2.4 times the discharge velocity of the secondary air curtain. Maintaining the respective air curtain velocity ratios within the aforenoted ranges minimizes the velocity gradient, and therefore shear instabilities, between the adjacent air curtains along the length of the interface between the adjacent air curtains, thereby resulting in less entrainment of air from the higher velocity air curtain into the lower velocity air curtain. The exact optimal air curtain velocity ratios in any given application are dependent upon the absolute discharge velocities of the respective air curtains and the particular geometry of the application, including the respective discharge angles of the primary, secondary and tertiary air curtains.

The present invention has been described herein in detail as applied to a refrigerated merchandiser of the type customarily found in supermarkets and like establishments. It is to be understood, however, that the aforementioned description is exemplary, not limiting. Rather, the present invention may be readily applied in other applications wherein it is desired to limit passage of fluid between a first environment that includes a first fluid at a first condition and interfaces with a second environment that includes a second fluid at a second condition.

For purposes of this invention, it is to be understood that the discharge velocity referred to herein may be expressed in conventional terms as units of distance per unit of time, e.g. meters per second, or as a mass flow rate, that is in units of kilograms per minute, or the like.

Many modifications and variations of the present invention may be recognized by those skilled in the art in light of the above teachings that will fall within the spirit and scope of the present invention. The preferred embodiments of this invention have been disclosed. Accordingly, within the scope of the appended claims, the invention may be practiced otherwise than as specifically described. For this reason the following claims should be studied to determine the true scope and content of this invention.

What is claimed is:

1. A method for establishing a separation barrier at an interface between a first environment having a fluid at a first condition and a second environment having a fluid at a second condition comprising:

directing a first stream of fluid drawn from the first environment across the interface between said first environment and said second environment along a first path generally parallel to the interface, thereby establishing a primary fluid curtain along the interface;

directing a second stream of fluid drawn from the second environment across the interface between said first environment and said second environment along a second path at an angle of divergence with the first path in a direction towards said second environment, thereby establishing a tertiary fluid curtain outwardly of said primary fluid curtain, the angle of divergence between said second path and said first path ranging from about 10 degrees to about 70 degrees; and directing a third stream of a fluid along a third path between said first path and said second path at a first interior angle with said first path ranging from about 5 degrees to about 35 degrees and at a second interior angle with said second path ranging from about 5 degrees to about 35 degrees, thereby establishing a secondary fluid curtain intermediate said primary fluid curtain and said tertiary fluid curtain.

2. A method for establishing a separation barrier between a first environment and a second environment as recited in claim 1 wherein said second interior angle ranges from 15 degrees to 35 degrees.

3. A method for establishing a separation barrier between a first environment and a second environment as recited in claim 1 further comprising maintaining said third stream of fluid at a temperature in the range between a first relatively cooler temperature of the first fluid stream and a second relatively warmer temperature of the second fluid stream.

4. A method for establishing a separation barrier between a first environment and a second environment as recited in claim 1 further comprising:

directing the first fluid stream along the first path at a first discharge velocity;

directing the second fluid stream along the second path at a second discharge velocity greater than said first discharge velocity; and directing the third fluid stream along the third path at a third discharge velocity greater than the first discharge velocity and less than the second discharge velocity.

5. A method for establishing a separation barrier between a first environment and a second environment as recited in claim 4 further comprising maintaining the ratio of the second discharge velocity to the first discharge velocity at a magnitude of at least about 1.4.

6. A method for establishing a separation barrier between a first environment and a second environment as recited in claim 5 further comprising maintaining the ratio of the second discharge velocity to the first discharge velocity within the range of from about 1.4 to about 2.4.

7. A method for establishing a separation barrier between a first environment and a second environment as recited in claim 5 further comprising maintaining the ratio of the third discharge velocity to the first discharge velocity within the range of from about 1.2 to about 2.0.

8. A method for establishing a separation barrier between a first environment and a second environment as recited in claim 4 further comprising maintaining the ratio of the third discharge velocity to the second discharge velocity at a magnitude ranging from greater than 1.0 to about 1.25.

9. A refrigerated merchandiser comprising:

a display case having an exterior and an interior, said interior defining a refrigerated product display region having an open front interfacing with an ambient environment;

a first discharge outlet associated with said display case for directing a first stream of air at a relatively cooler temperature generally parallely across the open front of the merchandiser along a first path;

a second discharge outlet associated with said display case for directing a second stream of air a relatively warmer temperature generally outwardly across the open of the merchandiser along a second path at a divergent angle with respect to the first path ranging from about 10 degrees to about 70 degrees; and a third discharge outlet associated with said display case for directing a third air stream generally outwardly across the open front of the merchandiser along a third path, said third air outlet positioned between said first discharge outlet and said second discharge outlet, said third path diverging from said first path at an interior angle ranging from about 5 degrees to about 35 degrees and diverging from said second path at an interior angle ranging from about 5 degrees to about 35 degrees.

10. A refrigerated merchandiser as recited in claim 9 wherein said second interior angle ranges from 15 degrees to 35 degrees.

11. A refrigerated merchandiser as recited in claim 9 wherein said third stream of fluid has a temperature in the range between the relatively cooler temperature of the first air stream and the relatively warmer temperature of the second air stream.

12. A method for operating a refrigerated merchandiser having a display case defining a refrigerated product display region having an open front interfacing with an ambient environment, comprising:

directing a first stream of refrigerated air drawn from the product display region along a first path across the open front of the display case, thereby establishing a primary air curtain across the open front of the display case;

directing a second stream of ambient air drawn from exteriorly of the refrigerated merchandiser across the open front of the display case along a second path at an angle of divergence with the first path in a direction away from the open front of the display case, thereby establishing a tertiary air curtain outwardly of said primary air curtain, the angle of divergence between said second path and said first path ranging from about 10 degrees to about 70 degrees; and directing a third stream of air along a third path between said first path and said second path at a first interior angle with said first path ranging from about 5 degrees to about 35 degrees and at a second interior angle with said second path ranging from about 5 degrees to about 35 degrees, thereby establishing a secondary air curtain intermediate said primary air curtain and said secondary air curtain.

13. A method for operating a refrigerated merchandiser as recited in claim 12 further comprising:

discharging the first air stream from said first discharge outlet along the first path at a first discharge velocity;

discharging the second air stream from the second discharge outlet along the second path at a second discharge velocity greater than said first discharge velocity; and discharging the third air stream from the third discharge outlet along the third path at a third discharge velocity greater than the first discharge velocity and less than the second discharge velocity.

14. A refrigerated merchandiser as recited in claim 13 wherein the ratio of the second discharge velocity to the first discharge velocity has a magnitude of at least about 1.4.

15. A refrigerated merchandiser as recited in claim 13 wherein the ratio of the second discharge velocity to the first discharge velocity has a magnitude within the range of from about 1.4 to about 2.4.

16. A refrigerated merchandiser as recited in claim 15 wherein the ratio of the third discharge velocity to the first discharge velocity has a magnitude within the range of from about 1.2 to about 2.0.

17. A refrigerated merchandiser as recited in claim 15 wherein the ratio of the third discharge velocity to the second discharge velocity has a magnitude ranging from greater than 1.0 to about 1.25.

* * * * *

UNITED STATES PATENT AND TRADEMARK OFFICE

CERTIFICATE OF CORRECTION

PATENT NO. : 7,162,882 B2
APPLICATION NO. : 11/018281
DATED : January 16, 2007
INVENTOR(S) : Abbas A. Alahyari It is certified that error appears in the above-identified patent and that said Letters Patent is hereby corrected as shown below:

On the cover page, under Related U.S. Application Data. The reference to "application No. 10/752,134, filed on Jan. 6, 2004, now abandoned, and" is incorrect and should appear as --application No. 10/752,134, filed on Jan. 6, 2004, and--;

Column 3, Line 61. The word "van" is incorrect and should be replaced with --an--;

Column 5, Line 34. The word "enviroment" is incorrect and should be replaced with --environment--;

In the Claims, relating to Claim 9, Column 10, Line 8. The word "parallely" is incorrect and should be replaced with --parallelly--.

Signed and Sealed this

Tenth Day of July, 2007

JON W. DUDAS
*Director of the United States Patent and Trademark Office*